US010041329B2

(12) United States Patent
Osborne

(10) Patent No.: US 10,041,329 B2
(45) **Date of Patent: *Aug. 7, 2018**

(54) VALVE WITH PUMP ROTOR PASSAGE FOR USE IN DOWNHOLE PRODUCTION STRINGS

(71) Applicant: Lawrence Osborne, Acton, CA (US)

(72) Inventor: Lawrence Osborne, Acton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/700,108

(22) Filed: Sep. 9, 2017

(65) Prior Publication Data

US 2017/0370184 A1 Dec. 28, 2017

Related U.S. Application Data

(60) Continuation of application No. 14/634,598, filed on Feb. 27, 2015, now Pat. No. 9,759,041, which is a continuation-in-part of application No. 14/061,601, filed on Oct. 23, 2013, now Pat. No. 9,027,654, which is a continuation-in-part of application No. 12/766,141, filed on Apr. 23, 2010, now Pat. No. 8,545,190, and a division of application No. 13/089,312, filed on Apr. 19, 2011, now Pat. No. 8,955,601.

(60) Provisional application No. 62/085,633, filed on Nov. 30, 2014.

(51) Int. Cl.

| | |
|---|---|
| ***E21B 34/08*** | (2006.01) |
| ***E21B 43/12*** | (2006.01) |
| ***F04B 47/00*** | (2006.01) |

(52) U.S. Cl.

CPC ..... *E21B 34/08* (2013.01); *E21B 43/126* (2013.01); *F04B 47/00* (2013.01); *Y10T 137/0318* (2015.04)

(58) Field of Classification Search

CPC ..... E21B 43/126; E21B 43/10; E21B 43/105; E21B 43/128; E21B 34/08; E21B 34/06; F16K 15/00–15/207; F16K 17/00–17/42; F04B 47/00–47/145

See application file for complete search history.

(56) References Cited

U.S. PATENT DOCUMENTS

| | | | |
|---|---|---|---|
| 1,091,463 | A | 3/1914 | Vincent |
| 2,256,704 | A | 9/1941 | Crickmer et al. |
| 2,575,677 | A | 11/1951 | Neu |
| 2,669,248 | A | 2/1954 | Miller |
| 3,027,907 | A | 4/1962 | Lee |
| 3,498,056 | A | 3/1970 | Avery |
| 3,713,703 | A | 1/1973 | Brown |
| 3,818,929 | A | 6/1974 | Braukmann |

(Continued)

FOREIGN PATENT DOCUMENTS

CN 202612126 U 12/2012

*Primary Examiner* — George S Gray

(74) *Attorney, Agent, or Firm* — Ocean Law; Paul D. Chancellor

(57) ABSTRACT

Methods and apparatus for utilizing a valve with a pump rotor passage with a downhole production string, the pump rotor being on a rotatable rod with a bobbin moving along the rod between a position for opening the passage to fluid flow, when the bobbin is not seated on a shuttle seat, and a position for closing the passage to fluid flow, when the bobbin is seated on the shuttle seat. The pump rotor and rod are removable through the passage while leaving the pump stator in place upstream of the valve.

22 Claims, 12 Drawing Sheets

(56) References Cited

U.S. PATENT DOCUMENTS

| | | | | |
|---|---|---|---|---|
| 3,905,382 | A | 9/1975 | Waterston | |
| 3,952,766 | A | 4/1976 | Johnson | |
| 4,057,074 | A | 11/1977 | Fischer | |
| 4,519,574 | A | 5/1985 | Roper | |
| 4,880,060 | A | 11/1989 | Schwendemann et al. | |
| 5,305,777 | A | 4/1994 | Nakamura et al. | |
| 5,439,022 | A | 8/1995 | Summers et al. | |
| 5,571,002 | A | 11/1996 | Kokoi | |
| 5,873,414 | A | 2/1999 | von Gynz-Rekowski | |
| 6,289,990 | B1 | 9/2001 | Dillon et al. | |
| 6,863,124 | B2 | 3/2005 | Araux et al. | |
| 6,868,772 | B2 | 3/2005 | Rice et al. | |
| 7,443,067 | B2 | 10/2008 | Schlosser | |
| 7,628,170 | B2 | 12/2009 | Kok-Hiong et al. | |
| 7,666,013 | B1 | 2/2010 | Kopecky et al. | |
| 7,927,083 | B2 | 4/2011 | Simmons | |
| 8,397,742 | B2 | 3/2013 | Thrash et al. | |
| 2004/0107991 | A1 | 6/2004 | Hollister et al. | |
| 2007/0119599 | A1 | 5/2007 | Chavers et al. | |
| 2008/0041477 | A1* | 2/2008 | Shotter | E21B 34/06 137/876 |
| 2012/0070319 | A1 | 3/2012 | Pedrollo | |

* cited by examiner

VALVE WITH PUMP ROTOR PASSAGE FOR USE IN DOWNHOLE PRODUCTION STRINGS

PRIORITY CLAIM AND INCORPORATION BY REFERENCE

This application is a continuation of U.S. application. Ser. No. 14/634,598 filed Feb. 27, 2015 which claims the benefit of 62/085,633 filed Nov. 30, 2014 and which is a continuation-in-part of U.S. application. Ser. No. 14/061,601 filed Oct. 23, 2013, now U.S. Pat. No. 9,027,654, which is 1) a divisional of U.S. application. Ser. No. 13/089,312 filed Apr. 19, 2011, now U.S. Pat. No. 8,955,601 and 2) a continuation-in-part of U.S. application. Ser. No. 12/766,141 filed Apr. 23, 2010, now U.S. Pat. No. 8,545,190. All the above applications are now incorporated herein by reference, in their entireties and for all purposes.

BACKGROUND OF THE INVENTION

The present invention relates to a valve for use in a downhole production string. In particular, the valve includes a pump rotor passage.

Discussion of the Related Art

Downhole production equipment is located in hard to reach places and therefore presents significant challenges to operators during both normal and abnormal conditions.

Downhole production strings may include production facilities such as a valve between a rod driven pump and pipe through which a fluid is transported or produced. For various reasons a valve, pump, and/or pipe may need to be installed in or removed from a downhole location. For example, installation and recovery of production string parts may be for one or more of normal production set up and take down, maintenance, repair, and replacement.

Relocating production string parts to or from downhole stations is typically a time consuming process involving labor, equipment, and materials. With traditional production string parts, the sequence of steps required to assemble/disassemble and/or deploy/recover downhole production string parts frequently delays relocation operations.

To the extent that relocation delays are reduced, less production time is lost and production or surfacing of the desired resource, such as a liquid hydrocarbon from a subterranean reservoir, is enhanced.

SUMMARY OF THE INVENTION

The present invention provides a downhole production string valve that includes a pump rotor passage.

In an embodiment, a valve for use in a downhole production string comprises: a body, a shuttle slidably inserted in the body, and a bobbin for mating with the shuttle; the valve body and shuttle provide a pump rotor passageway; and, the passageway is for receiving a rotatable rod therethrough and the bobbin is for slidably contacting the rod; wherein during normal operation of the production string a pump driven by the rod pumps fluid through the passageway and during a pump rotor removal operation a rotor of the pump is passable through the passageway.

BRIEF DESCRIPTION OF THE DRAWINGS

The present invention is described with reference to the accompanying figures. The figures listed below, incorporated herein and forming part of the specification, illustrate the invention and, together with the description, further serve to explain its principles enabling a person skilled in the relevant art to make and use the invention.

DESCRIPTION OF THE PREFERRED EMBODIMENTS

The disclosure provided in the following pages describes examples of some embodiments of the invention. The designs, figures, and description are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed invention.

To the extent parts, components and functions of the described invention provide for exchange fluids, the suggested interconnections and couplings may be direct or indirect unless explicitly described as being limited to one or the other. Notably, indirectly connected parts, components and functions may have interposed devices and/or functions known to persons of ordinary skill in the art.

Figure 1:
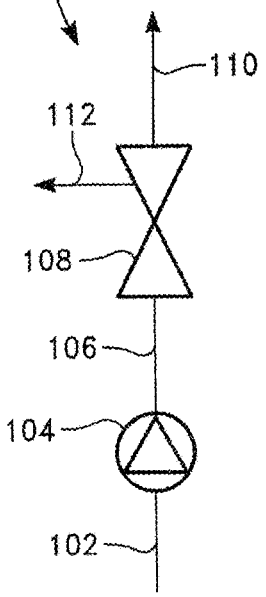
FIG. 1 is a first schematic diagram of a downhole production string including a valve.

FIG. 1 shows an embodiment of the invention 100 in the form of a schematic diagram. A spill or bypass valve 108 is interconnected with a pump 104 via a pump outlet 106. The pump includes a pump inlet 102 and the valve includes a valve outlet 110 and a valve spill port 112. In various embodiments, the inlets, outlets and ports are one or more of a fitting, flange, pipe, or similar fluid conveyance.

Figure 2B:
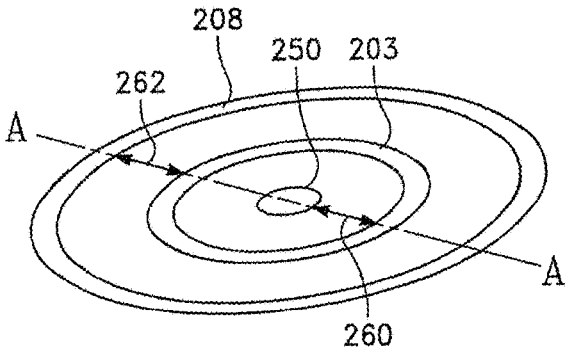
FIG. 2B is a cross-sectional view A-A of FIG. 2A.
Figure 2A:
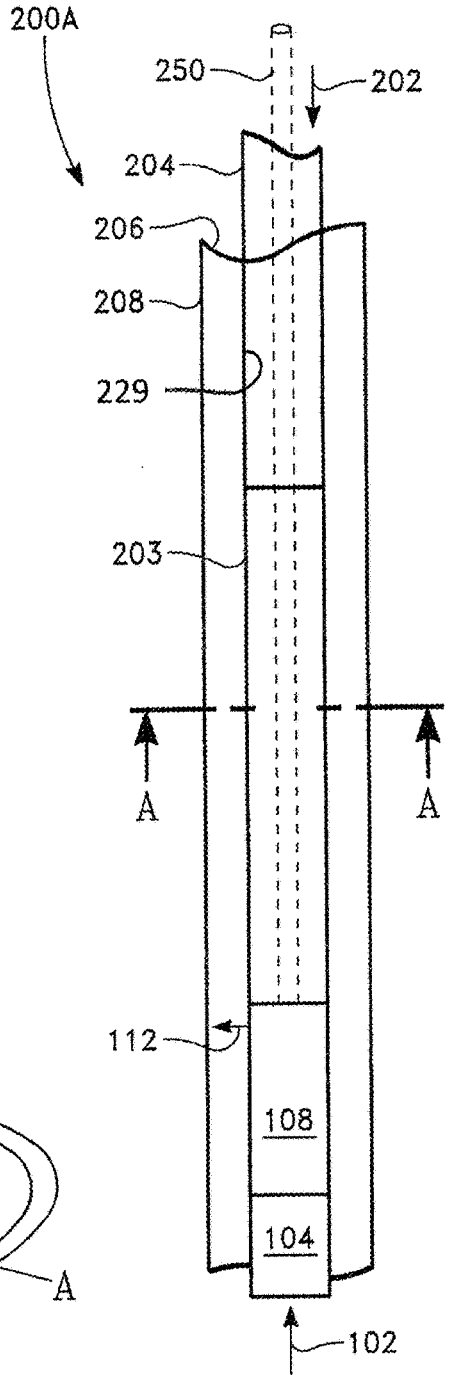
FIG. 2A is a second schematic diagram of a downhole production string including a valve.

FIG. 2A shows a section of a typical downhole production string 200A. The production string includes the bypass valve 108 interposed between the pump 104 and an upper tubing string 204. In some embodiments, a casing 208 surrounds one or more of the tubing string, valve, and pump. Here, an annulus 206 is formed between the tubing string and the casing. A production flow is indicated by an arrow 102 while a backflow is indicated by an arrow 202. In various embodiments, the bypass valve incorporates a spill port and in various embodiments the valve is operable to isolate backflows from one or more of the valve, portions of the valve, and the pump.

Some embodiments of the production string include an extended tubular element 203 coupled with the upper tubing string 204. For example, the extended tubular element may be a part of the valve or may be separate from the valve. In an embodiment, the extended tubular element is a valve body portion. The production may use a pump such as a rod driven pump with a pump drive rod 250 passing through the tubing string and interconnecting with the pump (pump interconnection is not shown).

FIG. 2B shows a cross-section A-A through the production string of FIG. 2A. Clearance(s) 260 between the rod 250 and the extended tubular element 203 and clearance(s) 262 between the extended tubular element and the casing 208 are shown. In particular, clearance(s) between the rod and the extended tubular element may be chosen to guide the rod and as such may be less than similar clearance(s) associated with the upper tubing string. In some embodiments, guards or ribs mounted within the extended tubular element or to the rod provide stand-offs to guide the rod.

Figure 3B:
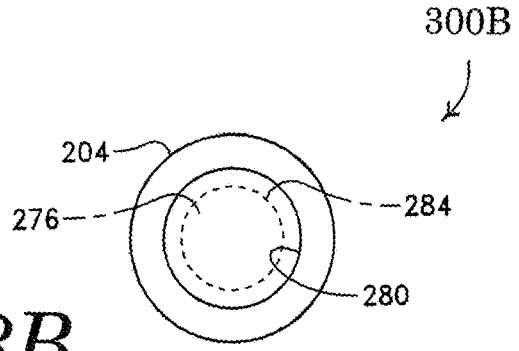
FIG. 3B is a cross sectional view through the valve illustrating pump rotor clearance.
Figure 3A:
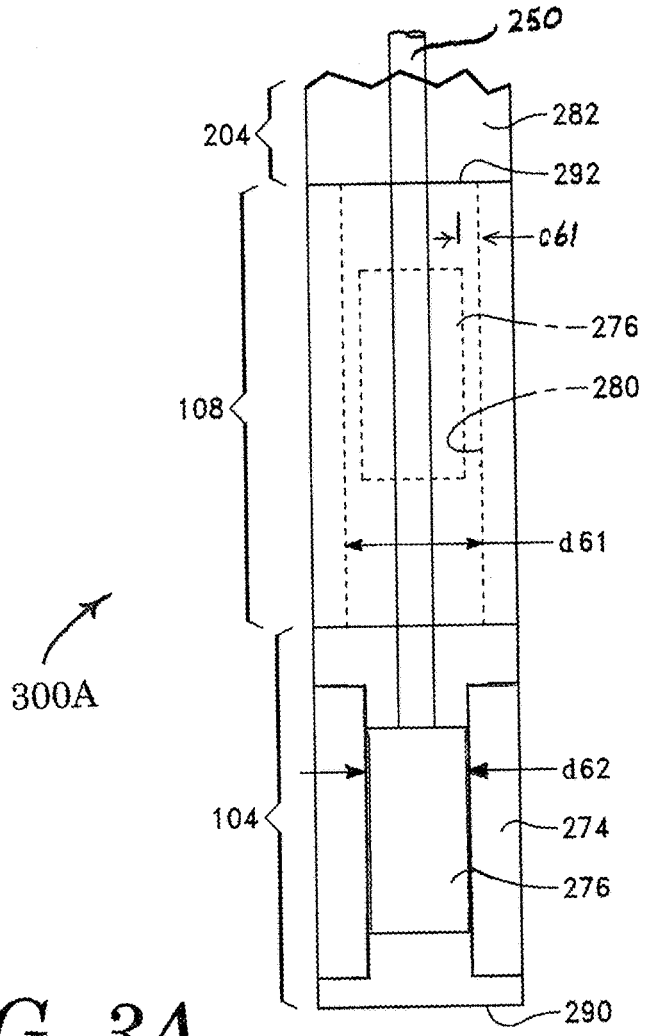
FIG. 3A is a third schematic diagram of a downhole production string including a valve with a pump rotor passage.

FIGS. 3A-B shows a schematic view of an end portion of a downhole production string assembly 300A-B. The assembly includes a valve 108 interposed between a rod 250 driven pump 104 and a section of production tubing 204. In some embodiments, a diverter valve with a rod mounted bobbin is used and in some embodiments, a progressive cavity pump is used.

The pump 104 includes a pump rotor 276 having an outer periphery 284 and an outer diameter d62 that may engage with a pump stator such as a surrounding pump stator 274. Rotation of the pump rotor causes a fluid at the pump inlet 290 to be drawn into the pump and discharged into the valve 108.

During fluid production operation, the rod 250 turns the pump rotor 276 such that a fluid is drawn into the pump intake 290, moves through the pump 104, through the valve 108, out of the valve 292, and into the production tubing 282.

The valve 108 includes a bore or pump rotor passage 280 having a minimum diameter d61 designed with a valve to rotor clearance c61 that allows for passage of the pump rotor 276 having a diameter d62 to pass through the valve. As used herein, bore refers to a passageway formed by any suitable method known to skilled artisans.

During operations requiring pump rotor 276 relocation, the rod 250 which is coupled to the pump rotor is used to move the rotor through the production string components. For example, during installation, the rotor is lowered on the rod through the production tubing 204, through the valve rotor passage 280, and into the pump stator 274.

FIGS. 4A-H show valve embodiments that include a pump rotor passage 400A-H.

Figure 4A:
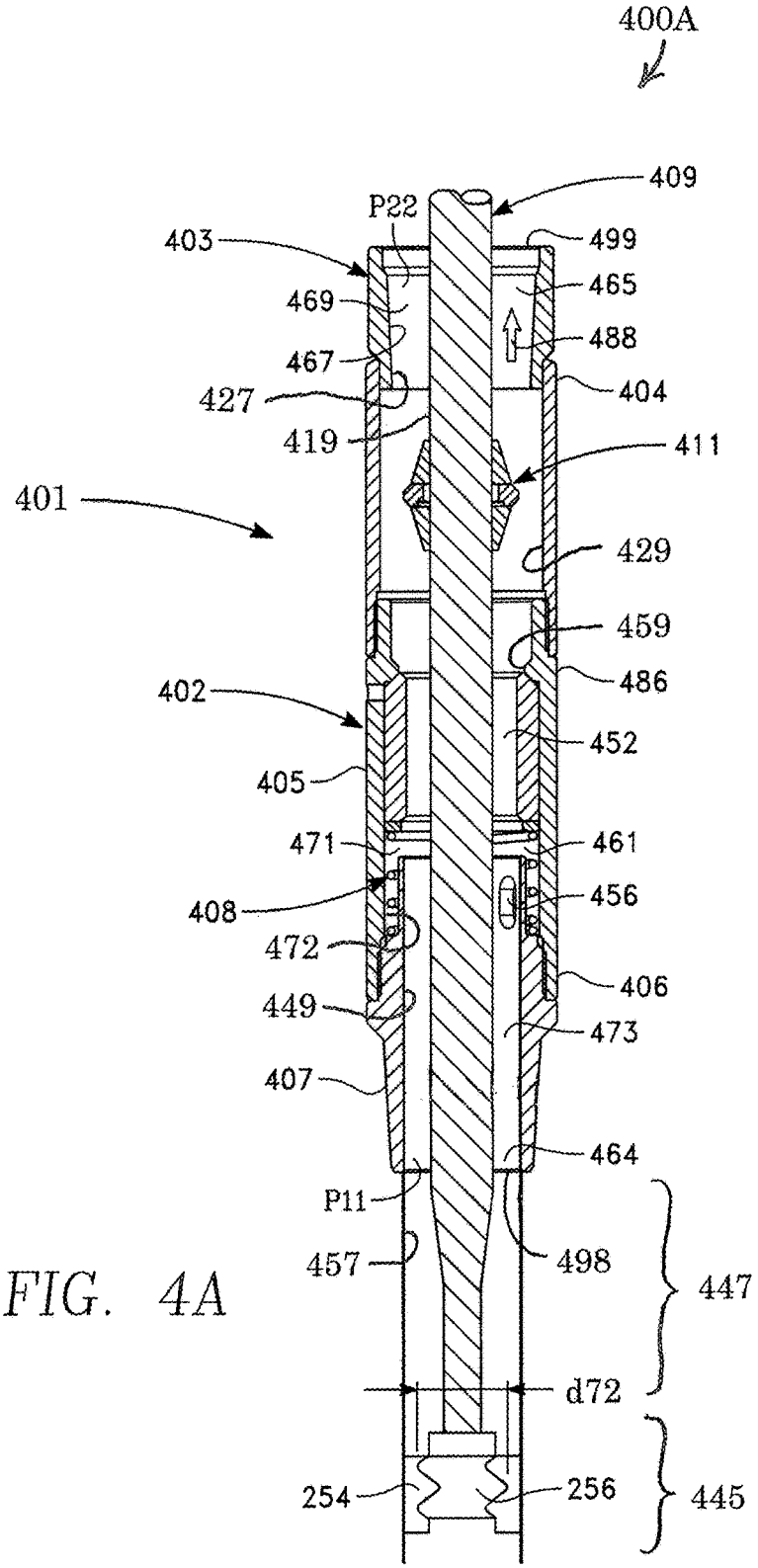
FIGS. 4A-H show a diverter valve that provides a pump rotor passageway in a rod driven downhole production system.
Figure 4B:
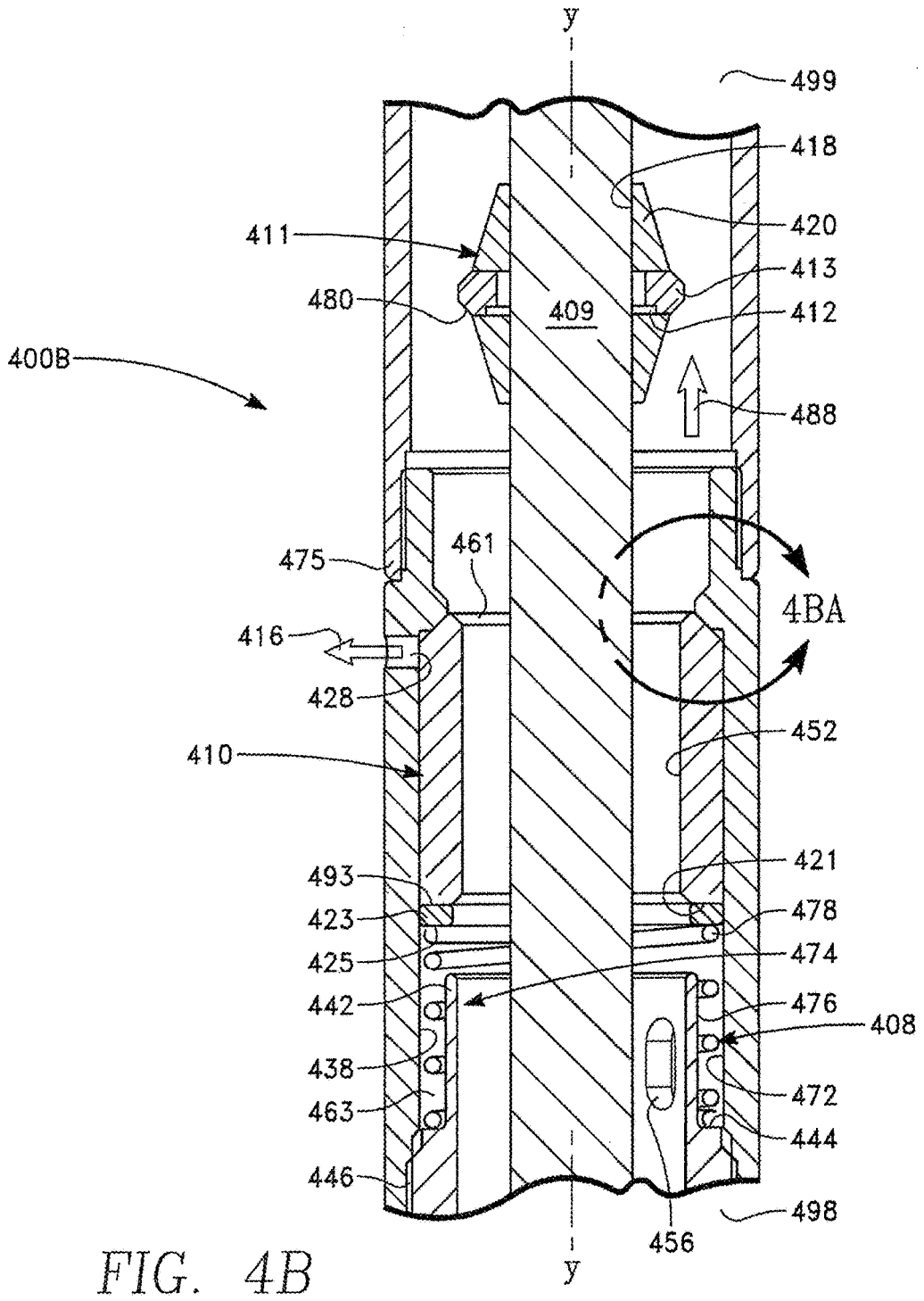
Figure 4C:
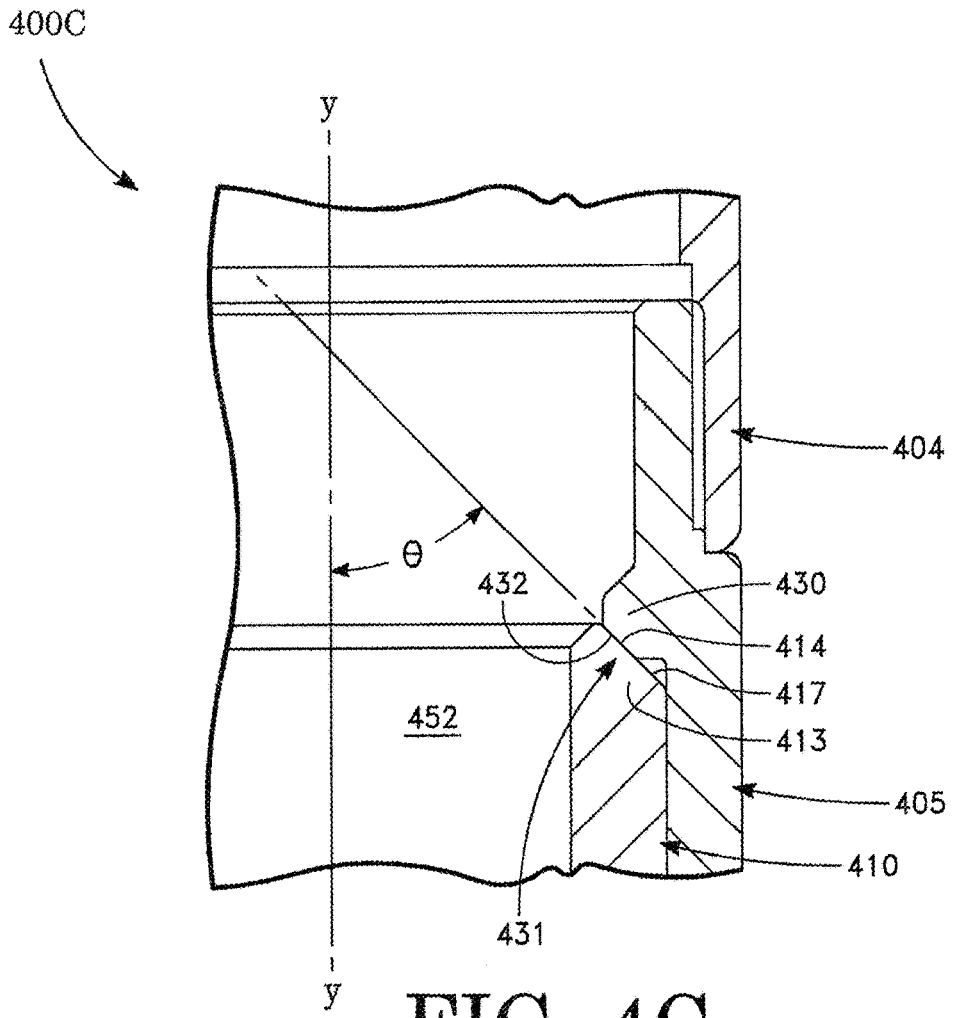

FIG. 4A shows diverter valve with a bobbin incorporated in a downhole production string assembly with a rod driven pump. FIG. 4B shows an enlarged middle portion of the valve of FIG. A in the bobbin up configuration. FIG. 4C shows the enlarged middle portion of the valve of FIG. A when the bobbin is down 400C. As seen in the figures, a valve body 402 includes an upper body or stand-off 404, a middle body 405, and a lower body 406.

In the embodiment of FIG. 4A, a valve 401 has a valve body 402 that extends between upper 403 and lower 407 adapters. In various embodiments, valve sizes include but are not limited to 2⅜ inch, 2⅞ inch, and 3½ inch. The lower adapter is coupled with a rod driven pump 445, such as a progressive cavity pump, having a pump rotor 256 with a maximum outer diameter d72 that is inserted in a pump stator 254. In some embodiments, the pump is directly connected with the valve or a lower adapter and, in some embodiments, an optional pump connector spool 447 is interposed between the pump and the lower adapter (as shown).

The upper body includes a first through hole 469. In some embodiments, the first through hole passes through an outlet chamber 465 of an upper adapter 403. And, in some embodiments, an inner surface of the adapter 467 is threaded. As used herein, the phrase through hole indicates a thru-hole passage. And, as persons of ordinary skill in the art will recognize, embodiments may have a through hole with a constant cross-section or a through hole of varying shape and/or cross-section as shown here. Embodiments of the adapter block a bobbin 411 from leaving the upper body 404. In an embodiment, the bobbin is in slidable contact with a polished rod portion 419, for example to reduce bobbin-rod friction to bobbin sliding.

The middle body includes a second through hole 471. In various embodiments, the second through hole provides or adjoins a shuttle chamber 461 and fluidly couples the valve outlet chamber 465 with a valve inlet chamber 464. The lower body includes a third through hole 473. In various embodiments, the third through hole passes through the inlet chamber 464. As used herein, the term couple refers to a connection that is either of a direct connection or an indirect connection that may further include interposed components.

Within the lower body 406, a spring shoulder such as an annular spring shoulder 444 for supporting a charge spring 408 projects inwardly from a first inner bore of the lower body 472. In some embodiments, the shoulder extends between the first inner bore of the lower body and a cylindrical spring guide 442.

And, in some embodiments, the shoulder 444 and the spring guide 442 are portions of a lower adapter 407 forming at least part of the lower body 406. In various embodiments, an upper end of the adapter 474 has a reduced outer diameter 476 such that the spring shoulder is formed where the diameter is reduced and the spring guide is formed along the length of the reduced diameter portion of the adapter. As shown, portions of the charge spring 408 are located in an annular pocket 463 between the first inner bore of the lower body 472 and the spring guide. The adapter and lower body may be integral or fitted together as by a threaded connection 446 or another connection known to a skilled artisan.

In some embodiments, a spring guide port 456 provides a means for flushing the annular spring pocket 463. As seen, the port extends between the lower chamber 464 and the annular pocket 463. Action of the charge spring 408 and/or pressure differentials between the pocket and the lower chamber provide a flushing action operative to remove solids such as sand that may otherwise tend to accumulate in the annular pocket.

Within the middle body 405, a middle body bore 438 is for receiving a valve shuttle 410. The charge spring 408 is for urging the shuttle toward the valve outlet end 499. This shuttle urging may be via direct or indirect charge spring contact. For example, embodiments utilize direct contact between a shuttle lower end 421 and an upper end of the charge spring 478. Other embodiments utilize indirect contact such as via an annular transition ring 423 having an upper face 493 contacting the shuttle carrier lower end and a lower face 425 contacting a charge spring upper end (as shown).

Near a lower end of the upper body 475, an inwardly projecting nose 430 includes a stationery seat 432 for engaging a closure 414 encircling a shuttle upper end 413. In various embodiments, the shuttle has a tapered upper end 417 and the closure is part of or extends from this taper. In various embodiments the seat and closure are configured to meet along a line forming an angle $\theta<90$ degrees with respect to a valve centerline y-y. Absent greater opposing forces, the charge spring 408 moves the shuttle 410 until the shuttle closure 414 is stopped against the stationery seat 432 to form a first seal 431.

The rod driven valve includes a central, rotatable, pump driving rod. The rod section shown is a lower rod section 409 with a central axis about centered on the valve centerline y-y. Not shown is this or another rod section's interface with a pump or an upper rod portion that is coupled to a rotating drive means.

The lower pump driving rod 409 passes through the valve body 402. In particular the rod passes through the first through hole 469, through the shuttle bore 452, and through the third through hole 473. Like the valve of FIG. 3A, the valve of FIG. 4A has a part dragged by fluid flow, the bobbin 411. The bobbin is slidably mounted on the rod above the shuttle as shown in FIG. 4A. The bobbin has a mounting hole for receiving the rod. Bobbin shapes include fluid-dynamic shapes suitable for utilizing drag forces operable to lift the bobbin when there is sufficient forward flow 488. For example, the bobbin may be shaped with substantially conical ends (as shown).

In an embodiment, the bobbin 411 includes a bobbin body 420 with a through hole 418 and a peripheral groove 412 defining a plane about perpendicular to the valve y-y axis. The groove is for receiving a bobbin ring 413 and the bobbin ring is for sealing a shuttle mouth 461. In various embodiments, the bobbin body is made from polymers such as plastics and from metals such as stainless steel. And, in various embodiments, the bobbin ring is made from polymers such as plastics and from metals such as stainless steel.

In some embodiments, the bobbin body 420 and ring 413 are integral and in some embodiments the bobbin has a bobbin hole insert (not shown) that is made from a material that differs from that of the bobbin body, for example, a metallic insert fitted into an outer plastic body. And, in an embodiment, the bobbin body is injection molded and a metallic bobbin ring is included in the mold during the injection molding process.

As further explained below, the bobbin 411 moves along the rod 409 in response to flow through the valve, rising above the shuttle 410 when there is sufficient forward flow 488, and falling to mate with the shuttle when there is insufficient forward flow and when there is reverse flow 489. See also the perspective cutaway view of a similar valve 400H of FIG. 4H.

Figure 4D:
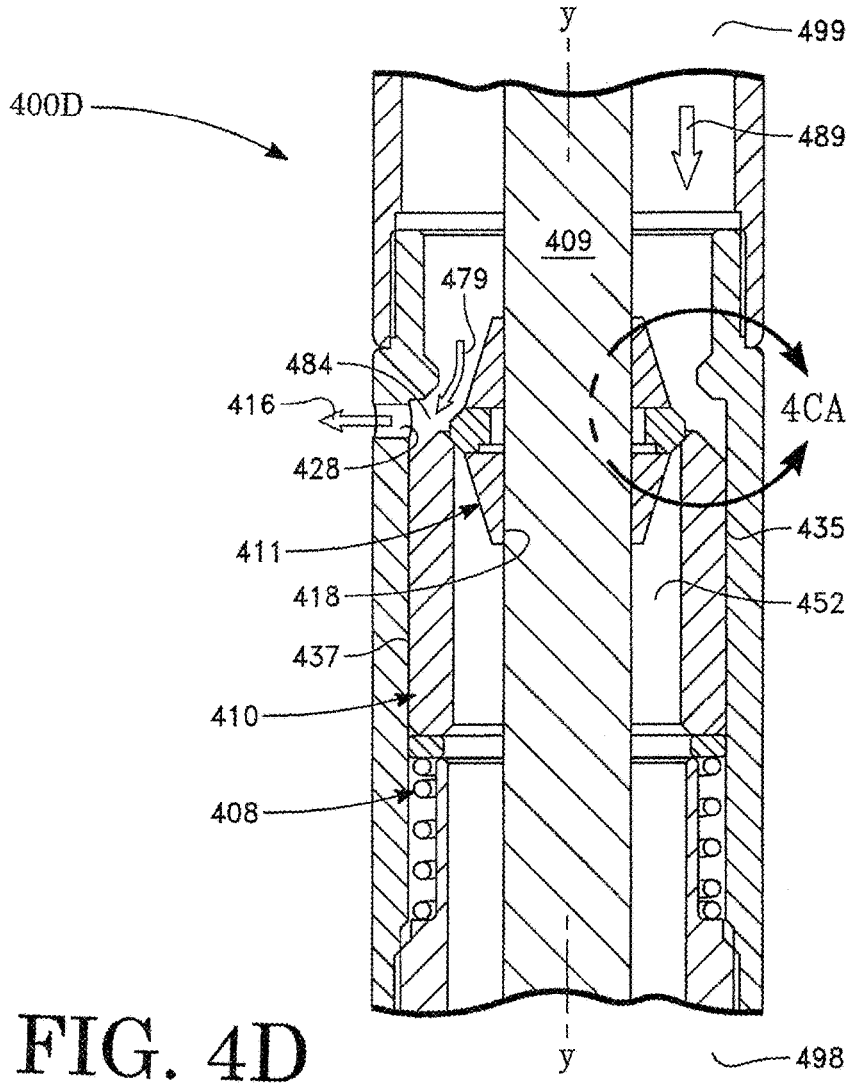
Figure 4E:
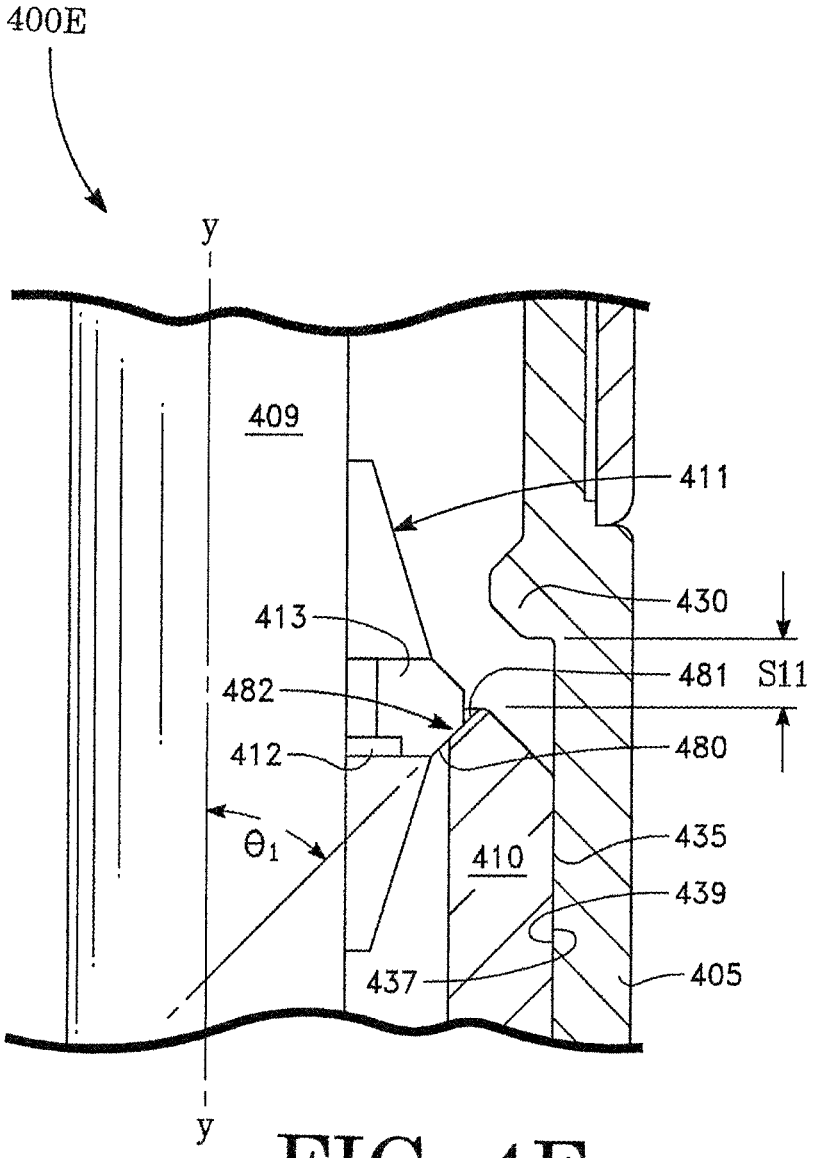

FIGS. 4D-E show the shuttle in a compressed spring position 400D-E. Unlike FIGS. 4A and 4B showing a normal forward flow 488 through the valve 401 with the shuttle stationery seat 432 and closure 414 mated, FIGS. 4D-E show the shuttle 410 separated from the closure 414 during a reverse flow 489, the charge spring 408 being compressed by movement of the shuttle toward the valve inlet end 498. Notably, one or more sliding seals about the shuttle provide a sliding seal 435 between the shuttle 410 and a middle body bore mated with the shuttle such as the middle body bore 438.

When there is sufficient forward flow 488 through the valve 400B, flow through the shuttle bore 452 lifts the bobbin 411 above the shuttle 410 and the charge spring 408 holds the shuttle against the valve body protruding nose 430. With the bobbin lifted above the shuttle, flow passes freely through the shuttle bore and into the valve outlet chamber 465.

Figure 4F:
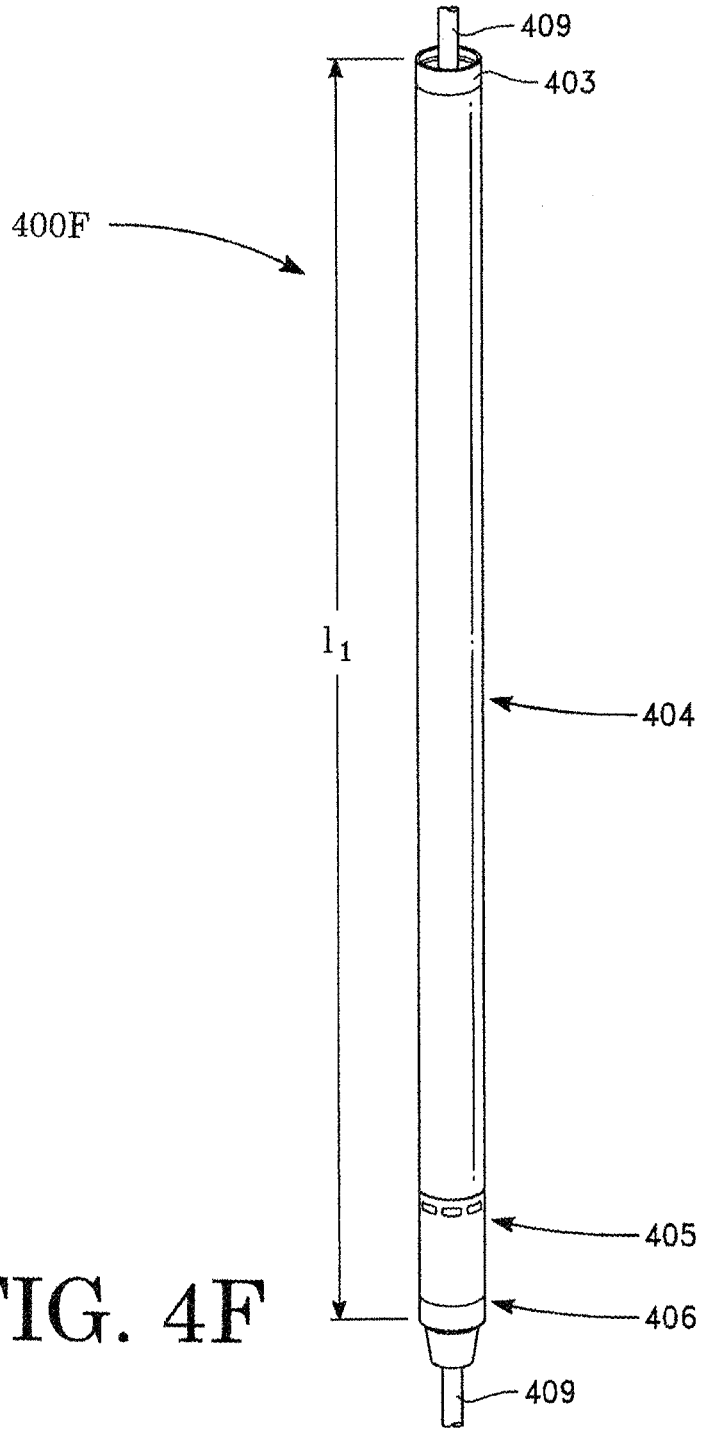

FIG. 4F shows a valve embodiment similar to the valve of FIG. 4A with an upper body 404 having a length l1. Here, an upper adapter 403 is configured, as by guards, spokes, annular obstructions or the like, to stop the bobbin from rising beyond the upper adapter. In various applications, a suitable length l1 may depend upon factors such as fluid viscosity, bobbin geometry, fluid flow rate ranges, and spacing between the bobbin and surrounding structures. In some embodiments, length l1 for 4 and 6 inch valve sizes is in the range of about 2 to 10 feet. And, in some embodiments, length l1 is in the range of about 4 to 20 times the valve size. Skilled artisans may utilize knowledge of the application and its constraints such as fluid properties to select suitable geometric variables including length l1.

In an embodiment, the upper body 404 or an extension thereof functions as a flow tube having an internal diameter (FTID) that is greater than the internal diameter of downstream production tubing 204 (PTID). Flow tube lengths may be 2-10 feet in some embodiments, 4-8 feet in some embodiments, and about 6 feet in some embodiments.

For a given rate of fluid production, the flow tube feature provides for lower fluid velocity in the flow tube as compared with production tubing fluid velocity and for managing the operation and travel of the bobbin 411. For example, as the ratio FTID/PTID increases, the likelihood of bobbin travel into the production tubing is reduced. And, for example, as the magnitude of FTID increases, the pump flowrate required to suspend the bobbin above the shuttle 410 increases. In various embodiments, the ratio FTID/PTID is in the range of 1.05 to 1.5 and in some embodiments, the ratio FTID/PDID is in the range of 1.1 to 1.3. As skilled artisans will appreciate, choosing this ratio depends, inter alia, on fluid properties and transport conditions.

Referring to FIG. 4C (see detail area 4BA of FIG. 4B), the rising shuttle is stopped when the shuttle closure 414 mates with the stationery seat 432 forming the body-shuttle seal 431. Forces acting on the bobbin 411 include drag forces due to flow through the shuttle bore 452 and gravitational forces. In various embodiments, when drag forces are overcome by gravitational forces due to insufficient forward flow, the bobbin falls relative to the shuttle 410.

Notably, during an inadequate flow event, the bobbin 411 falls relative to the shuttle 410 (see FIG. 4E and detail area 4CA of FIG. 4D), On shuttle contact, the bobbin ring closure 480 comes to rest against a shuttle mouth seat 481 forming a shuttle-bobbin seal 482 and blocking flow through the shuttle. Pressure forces at the valve outlet P22 act on the blocked shuttle and move it toward the valve inlet 498, a process that compresses the charge spring 408. When the bobbin ring closure and shuttle mouth seat are mated, forward flow is substantially limited. In some embodiments, flow is stopped but for leakage such as unintended leakage.

As seen, to the extent that the fluid head at the valve outlet P22 results in a fluid head force on the shuttle sufficient to overcome resisting forces including compressing the charge spring 408, the shuttle 410 moves toward the inlet end of the valve 498. In various embodiments, a shuttle diameter 437, approximated in some embodiments as a middle body bore diameter 439, provides an estimate of the area acted on by the fluid head and thus the fluid head force. Skilled artisans will adjust valve performance by determining valve variables including a spring constant "k" ($F=k*x$) of the charge spring to adapt the valve for particular applications.

Turning now to the spill port 428, it is seen that forward flow 488 and the body-shuttle seal 431 associated with forward flow enable blocking of the spill port 428. For example, the spill port may be blocked by forming an isolation chamber and/or by isolating or sealing the port 493. When the spill port is blocked, flow entering the valve inlet 498 passes through the shuttle through bore 452, out a shuttle mouth 461, into the valve outlet chamber 465, and out of the valve outlet 499.

Referring to FIG. 4D, it is seen that reverse flow 489 and the shuttle-bobbin seal 482 (see also FIG. 4E) associated with reverse flow enable opening of the spill port 428 as the shuttle 410 moves toward the inlet end of the valve 498 and the upper seal 431 is opened. When the shuttle-bobbin seal is closed, flow through the shuttle is blocked and a sliding shuttle-bore seal 435 blocks flow between the shuttle and the middle body bore 438. However, the shuttle-body seal 431 is now open and reverse flow entering the valve can pass around the nose 479 and leave the valve 416 via the spill port 428.

In some embodiments, reverse flow 489 and/or an adverse pressure gradient (outlet pressure P22>inlet pressure P11) move the shuttle 410 toward the valve inlet end 498 by a distance within dimension S11. This shuttle stroke unblocks the spill port 428 allowing flow entering the outlet chamber 489 to move through a spill pocket 484 with boundaries including the middle body bore 438 and the shuttle 410 before exiting the valve body 416 via one or more spill ports 428. And, in some embodiments, the illustrated spill port is one of a plurality of spill ports arranged around a valve body periphery 486.

The shuttle 410 of the valve 401 has a periphery 437 that seals, at least in part, against an internal bore of the valve such as the middle body bore 438. While some embodiments provide a shuttle with a substantially continuous sealing surface (as shown) for providing a sliding seal 435, various other embodiments provide a discontinuous sealing surface. For example, seals in the form of raised surface portions, rings in groves, snap rings, O-rings, and other suitable sealing parts and assemblies known to skilled artisans may be used.

Figure 4G:
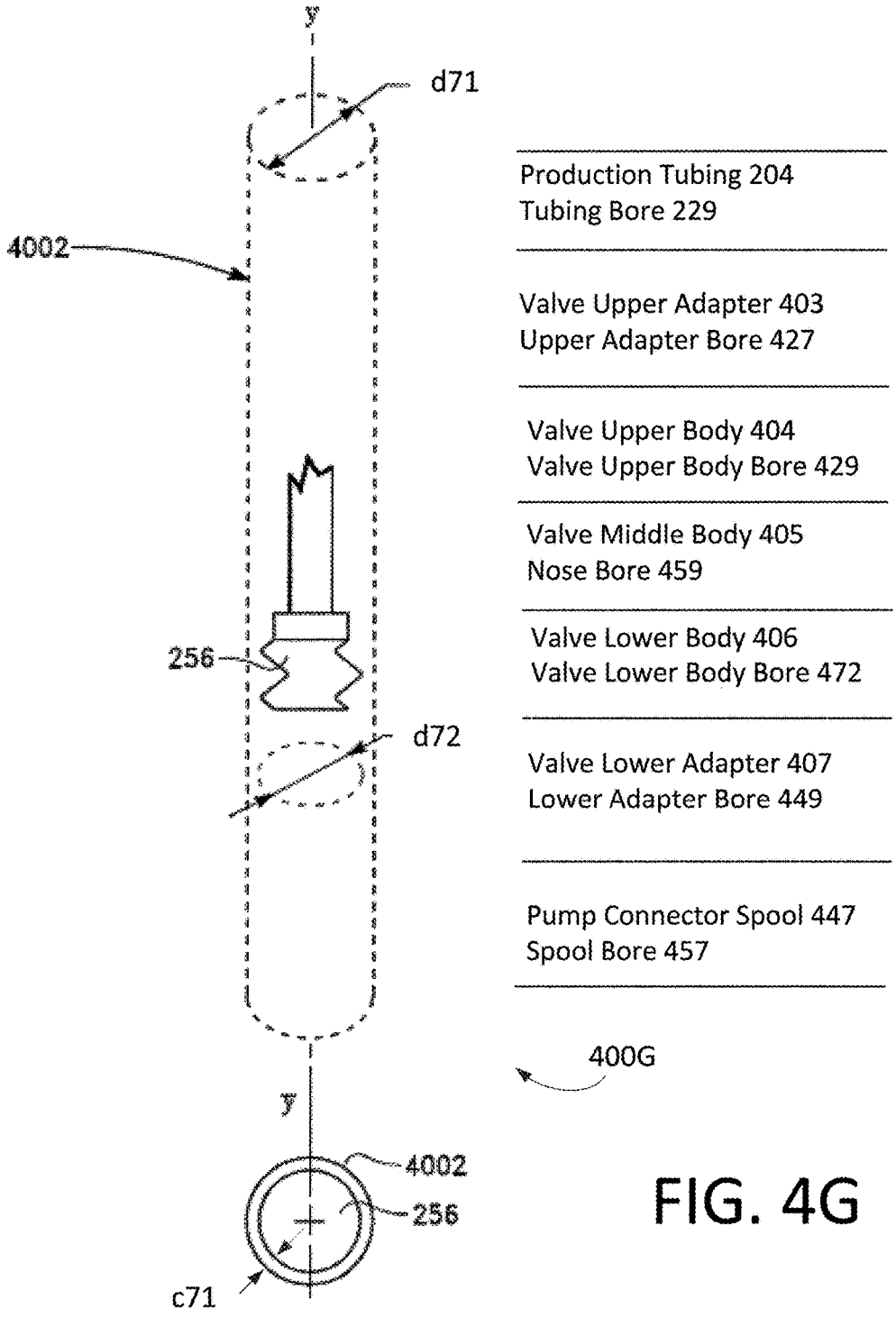
Figure 4H:
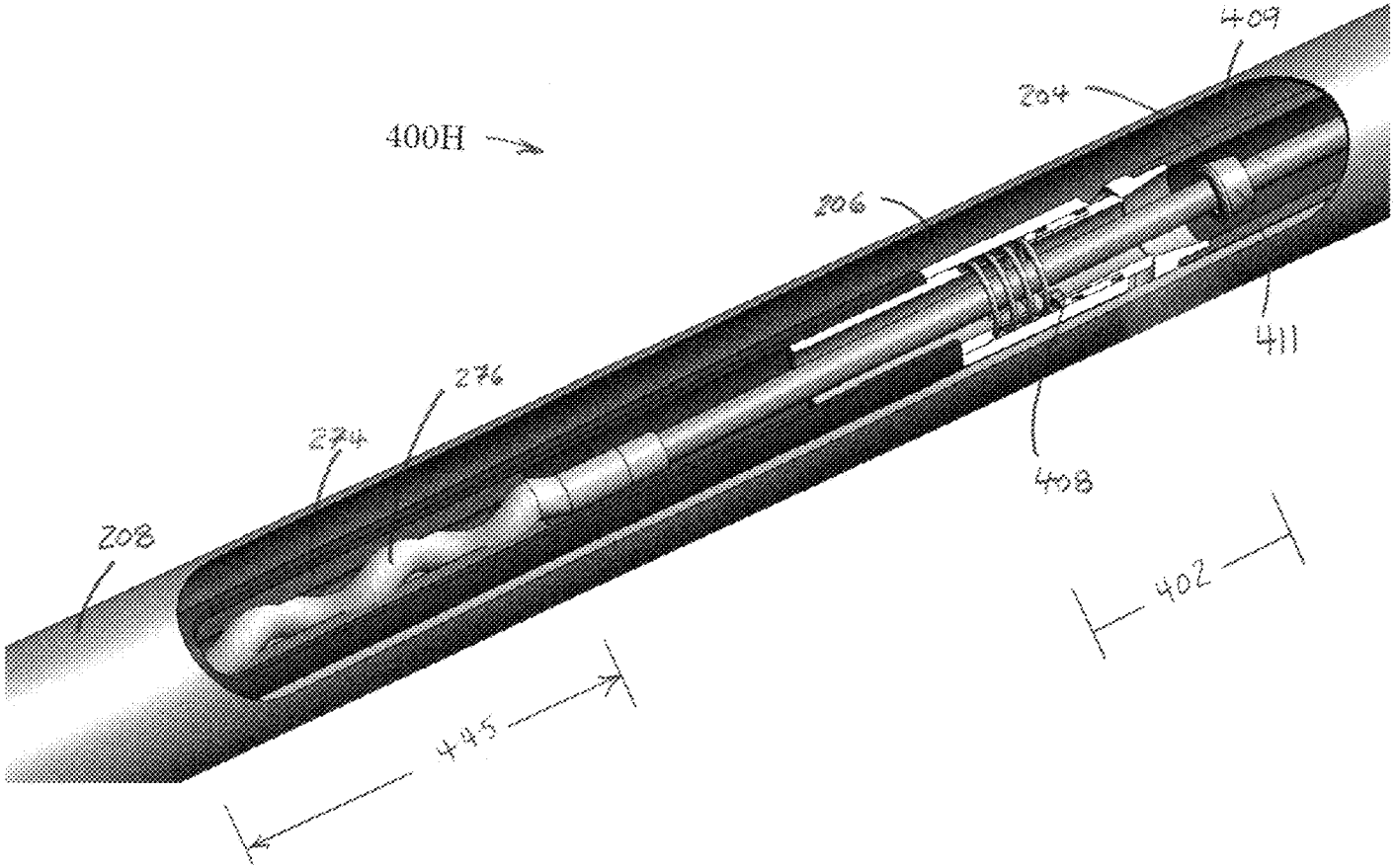

FIG. 4G shows a schematic outline of a valve rotor passage 400G. In particular, the figure illustrates a valve rotor passage for an end portion of a downhole production string assembly such as that of FIG. 4A.

In the figure, the dashed cylindrical space indicates a passageway 4002 of minimum diameter d71 extending from the pump 445 and/or pump coupling spool 447 (see FIG. 4A) and through the valve 401 into the production tubing 204 (See FIG. 2A). The pump rotor 256 has a maximum outside diameter for passage d72 such that when the rotor and passageway are coaxially arranged, a clearance c71 exists between the rotor and the passageway (i.e., d71>d72).

In various embodiments, the clearance c71 may be referred to as or in connection with drift and may be in the range of 10 to 100 thousandths of an inch and in some embodiments in the range of 20 to 30 thousandths of an inch.

Some embodiments provide a valve 401 bore that is full drifting of production tubing 204 size. That is, the valve provides a passageway that is at least as large as that of the production tubing such that, for example, a pump rotor 256 able to pass through the production tubing is also able to pass through the valve.

In an embodiment, a valve portion of the passageway 4002 is defined by i) a valve upper body 404 with a valve upper body bore 429 that is equal to or greater than d71, a valve middle body 405 with a valve middle body nose 430 and nose bore 459 that is equal to or greater than d71, and a valve lower body 406 with a valve lower body bore that is equal to or greater than d71.

In an embodiment, a valve outlet portion of the passageway 4002 is defined by a valve upper adapter 403 having a valve upper adapter bore 427 that is equal to or greater than d71 and production tubing 204 having a production tubing bore 229 that is equal to or greater than d71.

In an embodiment, a valve inlet portion of the passageway 4002 is defined by a valve lower adapter 407 having a valve lower adapter bore 449 that is equal to or greater than d71 and/or a pump connector spool 447 with a pump connector spool bore 457 that is equal to or greater than d71.

Figure 5A:
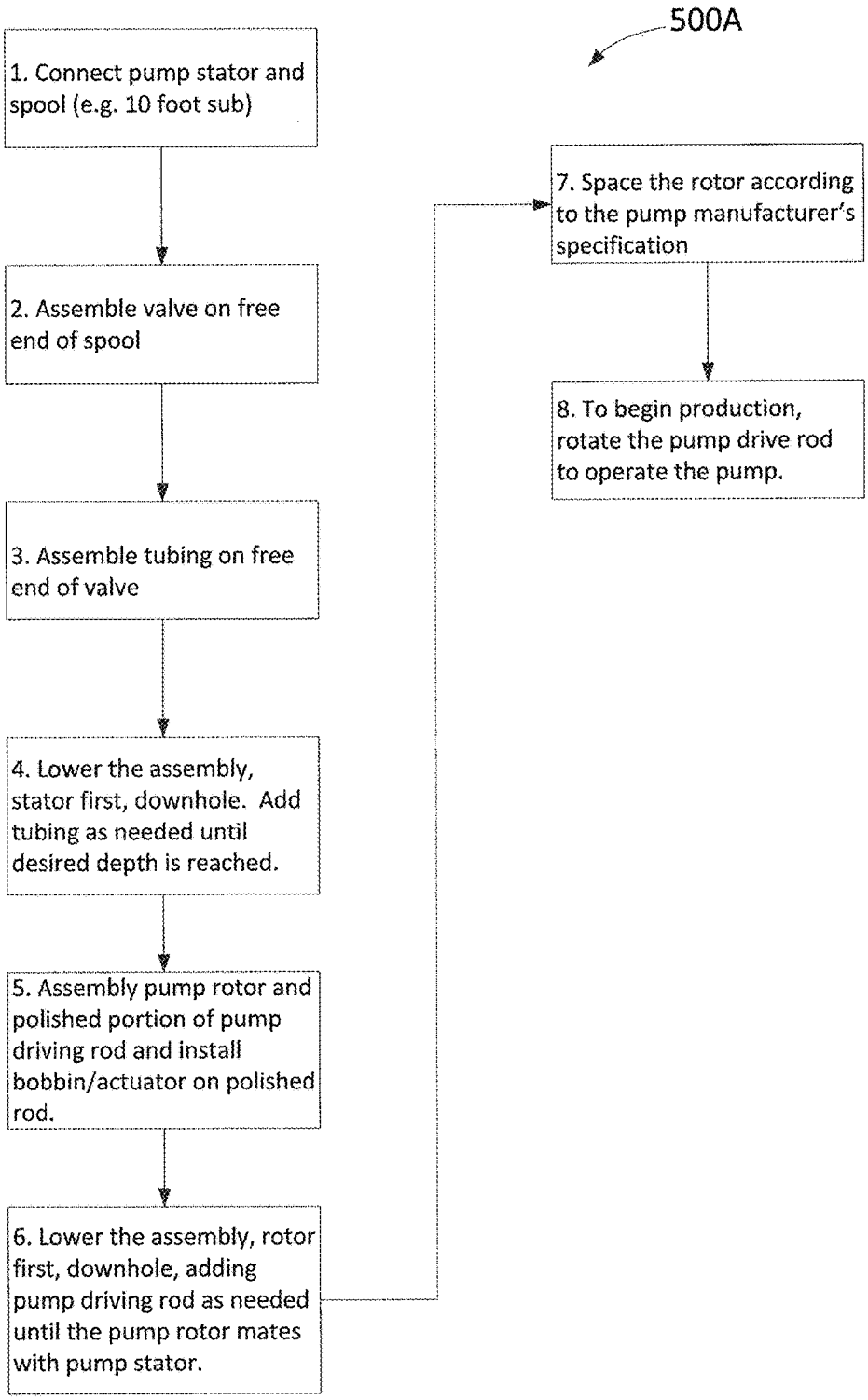
FIGS. 5A-B are flowcharts illustrating use of the valve of FIG. 4A and its pump rotor passageway.
Figure 5B:
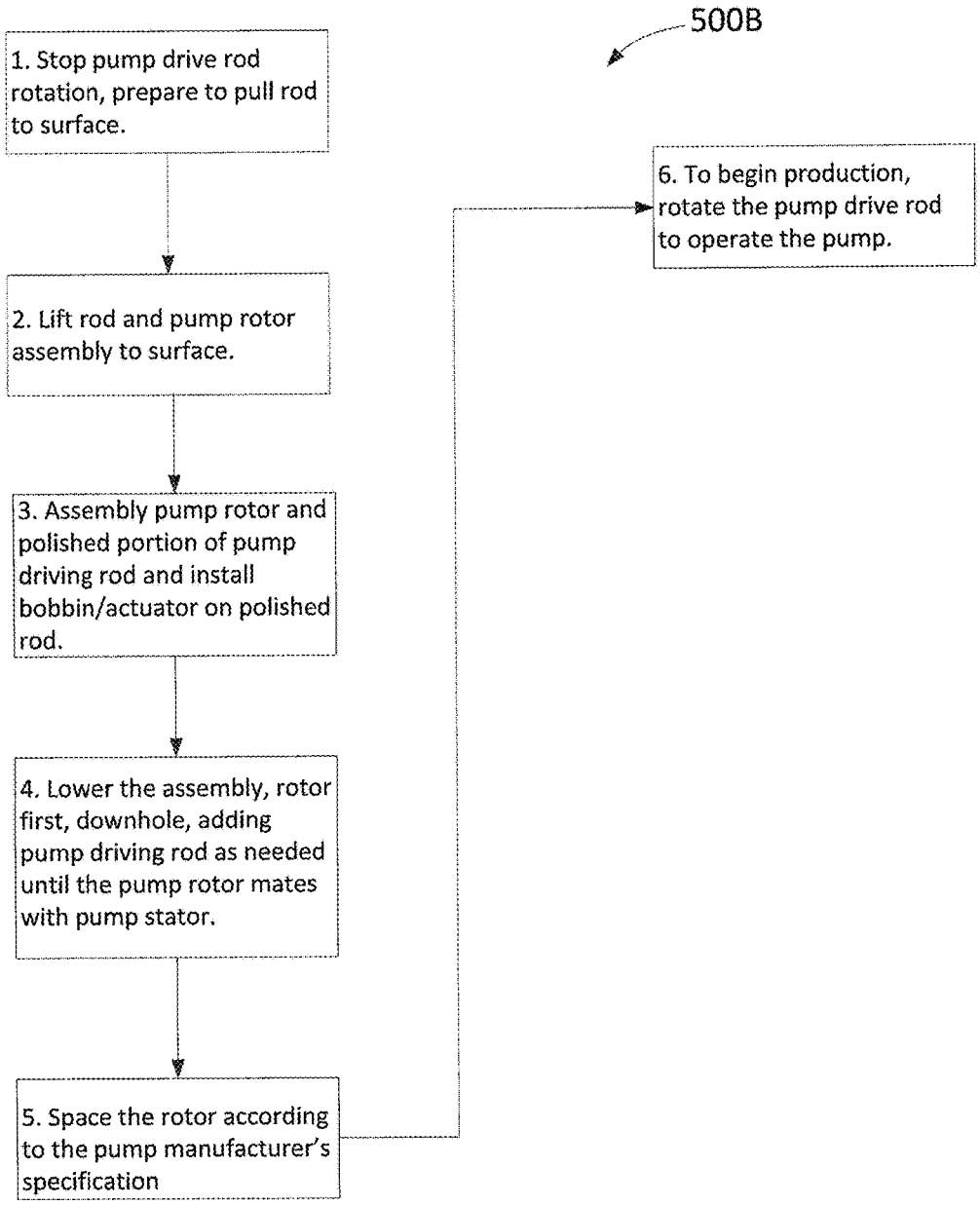

FIGS. 5A-B provide flowcharts illustrating exemplary operating scenarios of selected embodiments of the invention 500A-B.

FIG. 5A shows a sequence of steps for production facility installation, for example, steps for one of a new installation or an installation following a rework including removal of production tubing.

First, a stator lowering assembly is assembled and installed as seen in steps 1-4 of FIG. 5A.

In a step numbered 1, a pump stator (see e.g., 254, 274) and a spool (see e.g., 447) are coupled together. In a step numbered 2, a valve (see e.g., 108, 401) is coupled to the free end of the spool. In a step numbered 3, production tubing (see e.g., 204) is coupled to the free end of the valve. In a step numbered 4, the stator assembly, stator first, is lowered downhole. As needed, production tubing is added to the production tubing string until sufficient production tubing has been added to reach the desired depth, typically when the pump stator is submersed in reservoir zone that is or will be flooded with liquid. Note that in some embodiments, there is no spool such that the stator and production tubing are coupled together without a spool.

Second, a rotor lowering assembly is assembled and installed as seen in steps 5-8 of FIG. 5A.

In a step numbered 5, a pump rotor (see e.g., 256, 276) and a polished portion of pump driving rod (see e.g., 419) are coupled together and a bobbin or valve actuator (see e.g., 411) is installed on the rod. In a step numbered 6, the rotor assembly is inserted in the free end of the production tubing (see e.g., 204) and lowered downhole. Pump driving rod is added to the drive rod string as needed until the rotor meets and is inserted in the stator (see e.g., 274). In a step numbered 7, the pump rotor is spaced according to the pump manufacturer's specification. In a step numbered 8, in preparation for the beginning of production of liquids from the reservoir to the surface, the pump drive rod is readied for rotation and then rotated to operate the pump.

FIG. 5B shows a sequence of steps for production facility equipment removal and installation, for example, steps taken when the pump rotor must be replaced.

First, the pump rotor is lifted to the surface as seen in steps 1-2 of FIG. 5B.

In a step numbered 1, the pump drive rod rotation is stopped and preparations are made to pull the rod (see e.g., 409) to the surface. In a step numbered 2, the rod is lifted with the attached rotor (see e.g., 256, 276) until the rotor reaches the surface.

Second, a rotor lowering assembly is assembled and installed as seen in steps 3-6 of FIG. 5B.

In a step numbered 3, a new/renewed pump rotor (see e.g., 256, 276) and a polished portion of pump driving rod (see e.g., 419) are coupled together and a bobbin or valve actuator (see e.g., 411) is installed on the rod. In a step numbered 4, the rotor assembly is inserted in the free end of the production tubing (see e.g., 204) and lowered downhole. Pump driving rod is added to the drive rod string as needed until the rotor meets and is inserted in the stator (see e.g., 274). In a step numbered 5, the pump rotor is spaced according to the pump manufacturer's specification. In a step numbered 6, in preparation for the beginning of production of liquids from the reservoir to the surface, the pump drive rod is readied for rotation and then rotated to operate the pump.

The present invention has been disclosed in the form of exemplary embodiments. However, it should not be limited to these embodiments. Rather, the present invention should be limited only by the claims which follow where the terms of the claims are given the meaning a person of ordinary skill in the art would find them to have.

The invention claimed is:

1. A valve for use in a downhole production string comprising:

a valve body, a shuttle slidably inserted in the valve body, and a bobbin for mating with the shuttle;

wherein during a production string operation a pump is driven by a rod and during a production operation the bobbin is slidably contacting the rod, the bobbin slidable to the mating position with the shuttle.

2. The valve of claim 1 further comprising:

a production string operation wherein a pump rotor is removed from a pump and passed through the valve body and the shuttle.

3. The valve of claim 2 further comprising:

a production string operation wherein pumped fluid leaving the valve elevates the bobbin above the shuttle.

4. The valve of claim 3 further comprising:

a shuttle seat for blocking flow from the valve to the pump when the bobbin mates with the shuttle seat.

5. The valve of claim 4 further comprising:

a spring for biasing the shuttle to close a valve spill port.

6. The valve of claim 5 wherein a lack of flow through the valve body and the shuttle causes the bobbin to mate with the shuttle and overcomes the spring bias, the mating thereby opening the valve spill port.

7. The valve of claim 1 further comprising:

a flow tube for interconnecting a production tubing with the valve; and, the flow tube and the production tubing having respective inside diameters FTID and PTID wherein FTID>PTID.

8. A method of retrieving a rotor of a pump through a valve located downhole in a production string the method comprising the steps of:

providing a valve body, a shuttle positioned for sliding in the valve body, and a bobbin for mating with the shuttle;

providing a passageway through the valve body and shuttle; and, slidably engaging the bobbin with a pump rod extending through the passageway;

wherein during an operation of the production string, the pump is driven by the pump rod to pump fluid through the passageway and the pumped fluid lifts the bobbin away from the shuttle.

9. The method of claim 8 further comprising the step of:

wherein during an operation for removal of the pump rotor, the pump rod is used to retrieve the pump rotor by passing the pump rotor through the passageway.

10. The method of claim 8 further comprising the step of:

blocking flow between the valve and the pump when the shuttle is mated with the bobbin at a shuttle seat.

11. The method of claim 8 further comprising the step of:

selectively closing a valve spill port via a spring that biases the shuttle.

12. The method of claim 8 further comprising the steps of:

mating the bobbin with a shuttle seat when the fluid pumped through the passageway is insufficient to separate the bobbin and the shuttle seat; and, opening a valve spill port when a fluid head above the mated bobbin and seat overcomes a spring bias.

13. The method of claim 12 further comprising the steps of:

providing production tubing in the production string; and, coupling the production tubing and the valve with an interposed flow tube, the flow tube and the production tubing having respective inside diameters FTID and PTID wherein FTID>PTID.

14. The method of claim 8 further comprising the steps of:

providing production tubing in the production string; and, coupling the production tubing and the valve with an interposed flow tube, the flow tube and the production tubing having respective inside diameters FTID and PTID wherein FTID>PTID.

15. A valve for use in a downhole production string between a pump and a production tubing, the valve comprising:

a valve body, a shuttle positioned for sliding in the valve body, and a bobbin for mating with the shuttle; and, a passageway through the valve body and the shuttle;

wherein during a first operation of the production string the pump is driven by a rotatable pump rod on which the bobbin is slidably mounted and fluid pumped through the passageway lifts the bobbin away from a seat of the shuttle.

16. The valve of claim 15 further comprising:

wherein during an operation for removal of a pump rotor, the pump rod is used to retrieve the pump rotor by passing the pump rotor through the passageway.

17. The valve of claim 15 further comprising:

a flow path through a valve spill port established after the bobbin mates with the shuttle seat and a spring biasing the shuttle is compressed.

18. A method of operating a valve in a downhole production string, the method comprising the steps of:

locating a valve between a pump and a production tubing, the valve located downstream of the pump;

locating a spill port in a sidewall of a body of the valve; centrally locating a shuttle within the body, the shuttle for opening and closing the spill port;

providing a passageway through the valve, the passageway including passages through the shuttle and the body; and, protecting the pump by (i) passing a flow tending to fill the production tubing, the passing flow lifting a bobbin slidably mounted on a rotatable pump rod away from the shuttle, the shuttle being positioned to close the spill port, and (ii) spilling a flow through the spill port, tending to empty the production tubing, the shuttle being positioned to open the spill port.

19. The method of claim 18 wherein the pump is dismantled in place by passing a pump rotor through the passageway.

20. The method of claim 19 wherein the spilled flow is returned to a suction of the pump.

21. The method of claim 20 wherein a spring biasing the shuttle tends to close the spill port.

22. The method of claim 21 wherein the spring is located between a shuttle end and a valve body end.

* * * * *